US007335453B2

(12) United States Patent
Sacripante et al.

(10) Patent No.: US 7,335,453 B2
(45) **Date of Patent: *Feb. 26, 2008**

(54) TONER COMPOSITIONS AND PROCESSES FOR MAKING SAME

(75) Inventors: Guerino G. Sacripante, Oakville (CA); Fatima M. Mayer, Mississauga (CA); Edward G. Zwartz, Mississauga (CA); Nicoleta Mihai, Oakville (CA); Valerie M. Farrugia, Oakville (CA)

(73) Assignee: Xerox Corporation, Norwalk, CT (US)

( * ) Notice: Subject to any disclaimer, the term of this patent is extended or adjusted under 35 U.S.C. 154(b) by 258 days.

This patent is subject to a terminal disclaimer.

(21) Appl. No.: 10/973,866

(22) Filed: Oct. 26, 2004

(65) Prior Publication Data

US 2006/0088779 A1 Apr. 27, 2006

(51) Int. Cl.
*G03G 9/087* (2006.01)

(52) U.S. Cl. ..... 430/108.4; 430/109.4; 430/111.4

(58) Field of Classification Search ..... 430/108.4, 430/109.4, 111.4
See application file for complete search history.

(56) References Cited

U.S. PATENT DOCUMENTS

| | | | | |
|---|---|---|---|---|
| 3,967,962 | A * | 7/1976 | O'Malley | 430/120 |
| 4,254,207 | A | 3/1981 | Landoll et al. | |
| 4,385,107 | A | 5/1983 | Tanaka et al. | |
| 4,543,313 | A | 9/1985 | Mahabadi et al. | |
| 4,891,293 | A | 1/1990 | Sacripante et al. | |
| 4,973,539 | A | 11/1990 | Sacripante et al. | |
| 4,990,424 | A | 2/1991 | Van Dusen et al. | |
| 5,057,392 | A | 10/1991 | McCabe et al. | |
| 5,147,747 | A | 9/1992 | Wilson et al. | |
| 5,166,026 | A | 11/1992 | Fuller et al. | |
| 6,017,671 | A | 1/2000 | Sacripante et al. | |
| 6,383,205 | B1 | 5/2002 | Samson et al. | |
| 6,383,705 | B2 * | 5/2002 | Aoki et al. | 430/109.4 |
| 6,413,691 | B2 | 7/2002 | Daimon et al. | |
| 6,500,594 | B2 | 12/2002 | Hamano et al. | |
| 6,582,896 | B1 | 6/2003 | Ito et al. | |
| 6,607,864 | B2 | 8/2003 | Serizawa et al. | |
| 6,803,165 | B2 | 10/2004 | Ishimaru et al. | |
| 6,821,698 | B2 * | 11/2004 | Sawada et al. | 430/108.4 |
| 6,830,860 | B2 * | 12/2004 | Sacripante et al. | 430/109.3 |
| 6,864,030 | B2 * | 3/2005 | Shirai et al. | 430/109.4 |
| 6,872,499 | B2 * | 3/2005 | Sato et al. | 430/107.1 |
| 6,890,695 | B2 * | 5/2005 | Shirai et al. | 430/109.4 |
| 2003/0096184 | A1 * | 5/2003 | Kawaji et al. | 430/109.3 |
| 2003/0118929 | A1 * | 6/2003 | Shirai et al. | 430/108.7 |
| 2004/0142266 | A1 | 7/2004 | Sacripante et al. | |
| 2005/0208414 | A1 * | 9/2005 | Nakamura et al. | 430/110.2 |
| 2006/0063086 | A1 * | 3/2006 | Sacripante et al. | 430/109.4 |
| 2006/0160010 | A1 * | 7/2006 | Patel et al. | 430/109.4 |
| 2006/0216626 | A1 * | 9/2006 | Sacripante et al. | 430/109.4 |
| 2006/0222990 | A1 * | 10/2006 | Farrugia et al. | 430/109.4 |
| 2006/0292475 | A1 * | 12/2006 | Veregin et al. | 430/109.3 |
| 2007/0003856 | A1 * | 1/2007 | Farrugia et al. | 430/110.2 |

FOREIGN PATENT DOCUMENTS

| | | |
|---|---|---|
| EP | 1 055 971 A1 | 11/2000 |

* cited by examiner

*Primary Examiner*—Hoa Van Le
(74) *Attorney, Agent, or Firm*—Eugene O. Palazzo; Fay Sharpe LLP

(57) ABSTRACT

A toner composition is provider including a branched amorphous polyester resin and a crystalline polyester resin, wherein the toner possesses rheological properties yielding desired characteristics.

27 Claims, No Drawings

TONER COMPOSITIONS AND PROCESSES FOR MAKING SAME

RELATED APPLICATIONS AND CLAIM OF PRIORITY

This application claims priority to, is a continuation-in-part of, and incorporates by reference in full co-pending U.S. patent application Ser. No. 10/349,548, filed Jan. 22, 2003; and U.S. patent application Ser. No. 10/948,450 filed on Sep. 23, 2004.

BACKGROUND

1. Technical Field

The present disclosure relates, in various exemplary embodiments, to toner compositions and processes thereof. More specifically, the present disclosure relates to low melt toner compositions having a latitude of gloss levels depending on fusing temperature 2. Description of the Related Art Crystalline and branched resins are known. For example, crystalline refers to a polymer with a 3 dimensional order, and branched refers to a polymer with chains linked to form a crosslinked network.

Xerographic toners of a resin, a pigment, and a charge control agent are known. Toners useful for xerographic applications should exhibit certain performances related to storage stability, and particle size integrity. That is, it is desired to have the particles remain intact and not agglomerate until they are fused on paper. Since environmental conditions vary, the toners also should not substantially agglomerate up to a temperature of from about 50° C. to about 55° C. The toner composite of resins and colorant should also display acceptable triboelectrification properties that vary with the type of carrier or developer composition.

Another valuable toner attribute is the relative humidity sensitivity ratio, that is, the ability of a toner to exhibit similar charging behavior at different environmental conditions such as high humidity or low humidity. Typically, the relative humidity of toners is considered as the ratio between the toner charge at 80 percent humidity divided by the toner charge at 20 percent humidity. Acceptable values for relative humidity sensitivity of toner vary, and are dependant on the xerographic engine and the environment. Typically, the relative humidity sensitivity ratio of toners is expected to be at least 0.5, and preferably 1.

The fusing properties of a xerographic toner on paper are also of interest. Due to energy conservation measures, as well as more stringent energy characteristics placed on xerographic engines such as xerographic fusers, there has been pressure to reduce the fixing temperatures of toners onto paper, such as achieving fixing temperatures of from about 90° C. to about 120° C., to permit less power consumption and allow the fuser system to possess extended lifetimes. For a non-contact fuser, i.e., a fuser that provides heat to the toner image on paper by radiant heat, the fuser usually is not in contact with the paper and the image. For a contact fuser, i.e., a fuser which is in contact with the paper and the image, the toners should not substantially transfer or offset onto the fuser roller. Such offset is commonly referred to as hot or cold offset depending on whether the temperature is below the fixing temperature of the paper (cold offset), or whether the toner offsets onto a fuser roller at a temperature above the fixing temperature of the toner (hot offset).

Another desirable characteristic is sufficient release of the paper image from the fuser roll. For oil containing fuser rolls, the toner compositions may not contain a wax. For fusers without oil on the fuser (usually hard rolls), however, the toner composites will usually contain a lubricant like a wax to provide release and stripping properties. Thus, a toner characteristic for contact fusing applications is that the fusing latitude, i.e., the temperature difference between the fixing temperature and the temperature at which the toner offsets onto the fuser, should be from about 30° C. to about 90° C., and preferably from about 50° C. to about 90° C. Additionally, depending on the xerographic applications, other toner characteristics may be desired, such as providing high gloss images, such as from about 60 to about 80 Cardner gloss units, especially in pictorial color applications.

Other toner characteristics relate to nondocument offset, that is, the ability of paper images not to transfer onto adjacent paper images when stacked up at a temperature of about 55° C. to about 60° C.; nonvinyl offset properties; high image projection efficiency when fused on transparencies, such as from about 75 to about 100 percent projection efficiency and preferably from about 85 to 100 percent projection efficiency. The projection efficiency of toners can be directly related to the transparency of the resin utilized, and clear resins are desired.

Additionally, small sized toner particles, such as from about 3 to about 12 microns, and preferably from about 5 to about 7 microns, are desired, especially in xerographic engines wherein high resolution is a characteristic. Toners with the aforementioned small sizes can be economically prepared by chemical processes, such as that known as a direct or "In Situ" toner process which involves the direct conversion of emulsion sized particles to toner composites by aggregation and coalescence, or by suspension, microsuspension or microencapsulation processes.

Toner compositions are known, such as those disclosed in U.S. Pat. No. 4,543,313, the disclosure of which is totally incorporated herein by reference, and wherein there are illustrated toner compositions comprised of a thermotropic liquid crystalline resin with narrow melting temperature intervals, and wherein there is a sharp decrease in the melt viscosity about the melting point of the toner resin particles, thereby enabling matte finishes. The aforementioned toners of the '313 patent possess sharp melting points and can be designed for non-contact fusers such as Xenon flash lamp fusers generating 1.1 microsecond light pulses. For contact fusing applications, sharp melting materials can offset onto the fuser rolls, and thus the toners of the '313 patent may possess undesirable fusing latitude properties.

In U.S. Pat. No. 4,891,293, there are disclosed toner compositions with thermotropic liquid crystalline copolymers, and wherein sharp melting toners are illustrated. Moreover, in U.S. Pat. No. 4,973,539 there are disclosed toner compositions with crosslinked thermotropic liquid crystalline polymers with improved melting characteristics as compared, for example, to the thermotropic liquid crystalline resins of the '313 or '293 patents.

Furthermore, it is known that liquid crystalline resins may be opaque and not clear, and hence such toners are believed to result in poor projection efficiencies.

Low fixing toners comprised of semicrystalline resins are also known, such as those disclosed in U.S. Pat. No. 5,166,026, and wherein toners comprised of a semicrystalline copolymer resin, such as poly(alpha-olefin)copolymer resins, with a melting point of from about 30° C. to about 100° C., and containing functional groups comprising hydroxy, carboxy, amino, amido, ammonium or halo, and pigment particles, are disclosed. Similarly, in U.S. Pat. No. 4,952,477, toner compositions comprised of resin particles selected from the group consisting of semicrystalline polyolefin and copolymers thereof with a melting point of from about 50° C. to about 100° C., and containing functional groups comprising hydroxy, carboxy, amino, amido, ammonium or halo, and pigment particles, are disclosed. Similarly, in U.S. Pat. No. 4,952,477, toner compositions comprised of resin particles selected from the group consisting of semicrystalline polyolefin and copolymers thereof with a melting point of from about 50° C. to about 100° C. and pigment particles are disclosed. Although, it is indicated that some of these toners may provide low fixing temperatures of about 200° F. to about 225° F. (degrees Fahrenheit) using contact fusing applications, the resins are derived from components with melting characteristics of about 30° C. to about 50° C., and such resins are not believed to exhibit more desirable melting characteristics, such as about 55° C. to about 60° C.

In U.S. Pat. No. 4,990,424, toners including a blend of resin particles containing styrene polymers or polyesters, and components selected from the group consisting of semicrystalline polyolefin and copolymers thereof with a melting point of from about 50° C. to about 100° C. are disclosed. Fusing temperatures of from about 250° F. to about 330° F. (degrees Fahrenheit) are reported.

Low fixing crystalline based toners are disclosed in U.S. Pat. No. 6,413,691, and wherein a toner including a binder resin and a colorant, the binder resin containing a crystalline polyester containing a carboxylic acid of two or more valences having a sulfonic acid group as a monomer component, is illustrated. The crystalline resins of the '691 patent are believed to be opaque, resulting in low projection efficiency.

Crystalline based toners are disclosed in U.S. Pat. No. 4,254,207. Low fixing toners comprised of crosslinked crystalline resin and amorphous polyester resin are illustrated in U.S. Pat. No. 5,147,747 and U.S. Pat. No. 5,057,392, and wherein the toner powder is comprised, for example, of polymer particles of partially carboxylated crystalline polyester and partially carboxylated amorphous polyester that has been crosslinked together at elevated temperature with the aid of an epoxy novolac resin and a crosslinking catalyst.

Also of interest are U.S. Pat. Nos. 6,383,205; 6,017,671; and 4,385,107, the disclosures of which are totally incorporated herein by reference. U.S. Patent Pub. No. 2004/0142266, herein incorporated by reference in its entirety, describes a toner comprised of a branched amorphous sulfonated polyester resin, a crystalline sulfonated polyester resin, a colorant and an optional wax. In the toner of the '266 Publication, the crystalline resin displays or possesses a melting temperature of from about 50° C. to about 110° C.; the amorphous branched resin has an average molecular weight of about 2,000 to about 300,000 grams per mole; and the crystalline resin displays an average molecular weight of about 1,000 to about 50,000 grams per mole.

U.S. Pat. No. 6,500,594, herein incorporated by reference in its entirety, describes an electrophotographic developer comprising a toner and a carrier, wherein the toner contains a colorant and a crystalline resin, and wherein the carrier has a nitrogen-containing resin coating. The toner of the '594 patent preferably has specific rheological properties including certain dynamic viscosity characteristics. The toner has a storage elastic modulus (G') of $1\times10^6$ Pa or more and a loss elastic modulus (G") of $1\times10^6$ Pa or more at the angular frequency of 1 rad/sec and at 30° C. The elastic properties are related to toner hardness, stability, and fusing temperature. U.S. Pat. Nos. 6,582,896 and 6,607,864, herein incorporated by reference in their entirety, also describe toners having similar rheological characteristics.

Polyester based emulsion/aggregation resins comprising a combination of a first resin component with a second resin component may be prepared via direct coalescence method or process.

There is a need to continue to provide toners exhibiting a number of desirable properties, including melting temperature, fixing temperature, fusing latitude temperature, elasticity, viscosity, stability, particle size, refractive properties, gloss, and molecular weight. There is a need to provide a toner comprising a branched sulfonated amorphous polyester resin, a crystalline polyester resin, a colorant and an optional wax, displaying exemplary rheological properties. There is a need to provide a toner having a range of rheology and melting characteristics that result in the ability to achieve a broad range of gloss levels dependent on the fusing temperature.

This application describes toners and methods of making toners that solve one or more of the problems described above.

SUMMARY

In illustrative embodiments, a toner may be comprised of a crystalline resin, a branched amorphous resin, a colorant and optionally a wax. A toner composition may possess a Newtonian loss modulus (G") of about 60,000 to about 120,000 Pascal, optionally and more specifically about 80,000 to about 100,000 Pascal, at a temperature of about 65° C. to about 80° C. at a shear rate of about 0.05 to about 0.5 hertz. The toner composition may also exhibit a G" of about 30 to about 400 Pascal, optionally and more specifically about 50 to about 300 Pascal, at a temperature of about 150° C. to about 165° C. at a shear rate of about 0.05 to about 0.5 hertz. The toner composition may possess a storage modulus (G') of about 40,000 to about 90,000 Pascal, optionally and more specifically about 50,000 to about 70,000 Pascal, at a temperature of about 65° C. to about 80° C. at a shear rate of about 0.05 to about 0.5 hertz and a G' of about 10 to about 100 Pascal, optionally and more specifically about 20 to about 35 Pascal, at a temperature of about 150° C. to about 165° C. at a shear rate of about 0.05 to about 0.5 hertz. The toner composition may possess a ratio of loss modulus (G") to storage modulus (G') of about 1 to about 3 at a temperature of about 65° C. to about 75° C., and a ratio (G"/G') of about 5 to about 7 at a temperature of about 155° C. to about 165° C.

The toner composition may be comprised of a branched polyester resin and a crystalline polyester resin that are alkali sulfonated polyester resins comprising an alkali metal selected from the group consisting of lithium, sodium, potassium, and combinations thereof. The toner composition may comprise a colorant and a wax. The toner composition may be comprised of an amorphous branched resin that is present in an amount of from about 40 to about 90 percent of the toner, a crystalline resin that is present in an amount of from about 5 to about 40 percent of the toner, and a colorant that is present in an amount of from about 3 to about 15 percent of the toner.

Toner compositions may comprise an amorphous resin possessing a G" of about $1\times10^7$ to about $3\times10^7$ Pascal at a temperature of about 65° C. to about 75° C. and a G" of about 1,500 to about 3,000 Pascal at a temperature of about 155° C. to about 165° C. at a shear rate of about 0.05 to about 0.5 hertz, and possessing a G' of about $7\times10^6$ to about $9\times10^6$ Pascal at a temperature of about 65° C. to about 75° C. and a G' of about 10 to about 50 Pascal at a temperature of about 155° C. to about 165° C. at a shear rate of about 0.05 to about 0.5 hertz, and having a ratio of G"/G' of about 1 to about 5 at a temperature of about 65° C. to about 75° C. and a ratio of G"/G of about 10 to about 30 at a temperature of about 155° C. to about 165° C. Toner compositions may comprise a crystalline resin possessing a G" of about 800 to about 1200 Pascal at a temperature of about 65° C. to about 75° C. and a G" of about 8 to about 15 Pascal at a temperature of about 155° C. to about 165° C. at a shear rate of about 0.05 to about 0.5 hertz, and possessing a G' of about 60 to about 100 Pascal at a temperature of about 65° C. to about 75° C. and a G' of about 0.1 to about 0.5 Pascal at a temperature of about 155° C. to about 165° C. at a shear rate of about 0.05 to about 0.5 hertz, and possessing a ratio of G"/G' of about 10 to about 30 at a temperature of about 65° C. to about 75° C. and a ratio of G"/G of about 500 to about 700 at a temperature of about 155° C. to about 165° C.

Illustrative embodiments of the toner composition may exhibit a high gloss unit of about 50 to 80 at a temperature of about 80° C. to about 180° C. The toner compositions may have a fusing temperature of about 80° C. to about 120° C. and a fusing latitude of about 50° C. to about 100° C.

Toner embodiments may be incorporated in an electrophotographic developer with a carrier. Toner compositions may be included in a xerographic apparatus, the apparatus comprising a charging component, a photoreceptor component, a development component, a transfer component, and an optional cleaning component.

There have thus been outlined the more important features of the invention in order that the detailed description that follows may be better understood, and in order that the present contribution to the art may be better appreciated. There are, of course, additional features of the invention that will be described below and which will form the subject matter of the claims appended hereto.

DETAILED DESCRIPTION

Toner compositions described herein have a wide gloss range and wide fuser latitude. Toner compositions may be fused at high speeds for lower gloss applications such as text/business documents on uncoated paper. For the thicker glossier paper used typically in graphic arts applications, a higher fuser temperature (e.g., 180° C.) enables the print gloss to match the substrate gloss. The wide fusing latitude allows the toner to be fused over a wide range of fuser roll temperatures without hot offsetting.

Aspects of the present exemplary embodiments relate to a toner composition comprising specific rheological characteristics. A toner composition may possess dynamic viscosity measurements, melt processing characteristics, gloss, and fusing temperature properties. A toner composition may possess a Newtonian loss, or viscous, modulus (G") of about 80,000 to about 100,000 Pascal, or optionally about 60,000 to about 100,000 Pascal, at a temperature of about 65° C. to about 75° C. or about 80° C. at a shear rate of about 0.05 to about 0.5 hertz. It may also possess a G" of about 50 to about 300 Pascal at a temperature of about 155 to about 165° C. at a shear rate of about 0.05 to about 0.5 hertz. The composition may possess a storage, or elastic modulus (G) of about 50,000 to about 70,000 Pascal, or optionally about 40,000 to about 90,000 Pascal, at a temperature of about 65° C. to about 75° C. or about 80° C. at a shear rate of about 0.05 to about 0.5 hertz and a G' of about 10 to about 100 Pascal, or optionally about 20 to about 35 Pascal, at a temperature of about 155° C. to about 165° C. at a shear rate of about 0.05 to about 0.5 hertz.

In one embodiment, a toner may comprise a branched amorphous resin or polymer, a crystalline resin or polymer, and a colorant. Optionally, the toner composition may include a wax. In illustrative embodiments, the branched amorphous resin and the crystalline resin are each alkali sulfonated polyester resins. The alkali metal in the respective sulfonated polyester resins may independently be lithium, sodium, or potassium. In further embodiments, the branched amorphous resin and the crystalline resin are each a lithium sulfonated polyester resins. The toner compositions may be ultra low melt toners that exhibit a relatively low minimum fix temperature of about 90° C. to about 120° C. Other features and characteristics of illustrative toner compositions are described herein.

A toner composition may include a crystalline resin. The crystalline resin may be, for example, an alkali sulfonated polyester resin. Examples of polyester based crystalline resins include, but are not limited to alkali copoly(5-sulfoisophthaloyl)-co-poly(ethylene-adipate), alkali copoly(5-sulfoisophthaloyl)-copoly(propylene-adipate), alkali copoly (5-sulfoisophthaloyl)-coply(butylene-adipate), alkali copoly (5-sulfo-isophthaloyl)-copoly(pentylene-adipate), and alkali copoly(5-sulfo-iosphthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-co-poly (butylene-adipate), alkali copoly(5-sulfo-isophthaloyl)-copoly(pentylene-adipate), alkali copoly(5-sulfo-isopthaloyl)-copoly(hexylene-adipate), alkali copoly(5-sulfo-isophthaloyl)-copoly(octylene-adipate), alkali copoly (5-sulfoisophthaloyl)-copoly(ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly (propylene-sebacate), alkali copoly(5-sulfo-isophthaloyl)-copoly(butylene-sebacate), alkali copoly(5-sulfo-isopthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly (butylene-adipate), alkali copoly(5-sulfo-isophthaloyl)-copoly(pentylene-adipate), alkali copoly(5-sulfo-isophthaloyl)copoly(hexylene-adipate), poly(octylene-adipate), and wherein alkali is a metal like sodium, lithium or potassium. In embodiments, the alkali metal may be sodium.

The crystalline resin may be, for example, present in an amount of from about 5 to about 30 percent by weight of the toner components, optionally and more specifically from about 15 to about 25 percent by weight of the toner components. The crystalline resin may possess various melting points of, for example, from about 30° C. to about 120° C., and optionally from about 50° C. to about 90° C. The crystalline resin may have, for example, a number average molecular weight ($M_n$), as measured by gel permeation chromatography (GPC) of, for example, from about 1,000 to about 50,000, and optionally from about 2,000 to about 25,000. The average molecular weight ($M_w$) of the resin may be, for example, from about 2,000 to about 100,000, and optionally from about 3,000 to about 80,000, as determined by gel permeation chromatography using polystyrene standards. The molecular weight distribution ($M_w/M_n$) of the crystalline resin is, for example, from about 2 to about 6, and in certain embodiments more specifically, from about 2 to about 4.

The crystalline resins may be prepared by the polycondensation process of reacting an organic diol and an organic diacid in the presence of a polycondensation catalyst. Generally, a stochiometric equimolar ratio of organic diol and organic diacid may be utilized. However, in some instances, wherein the boiling point of the organic diol is from about 180° C. to about 230° C., an excess amount of diol may be utilized and removed during the polycondensation process. The amount of catalyst utilized may vary, and can be selected in an amount, for example, of from about 0.01 to about 1 mole percent of the resin. Additionally, in place of an organic diacid, an organic diester can also be selected, and where an alcohol byproduct is generated.

Examples of organic diols include but are not limited to aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride, thereof; and an alkali sulfo-organic diacid such as the sodio, lithio or potassium salt of dimethyl-5-sulfo-isopthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, from about 40 to about 50 mole percent of the resin, and the alkali sulfoaliphatic diacid can be selected in an amount of from about 1 to about 10 mole percent of the resin.

The present toners may include a branched amorphous resin. In embodiments, the branched amorphous resin may be an alkali sulfonated polyester resin. Examples of suitable alkali sulfonated polyester resins include, but are not limited to, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly (ethoxylated bisphenol-A-5-sulfo-isophthalate), and wherein the alkali metal is, for example, a sodium, lithium or potassium ion.

The branched amorphous polyester resin, in embodiments, may possess, for example, a number average molecular weight ($M_n$), as measured by gel permeation chromatography (GPC), of from about 10,000 to about 500,000, and optionally from about 5,000 to about 250,000; an average molecular weight ($M_w$) of, for example, from about 20,000 to about 600,000, and optionally from about 7,000 to about 300,000, as determined by gel permeation chromatography using polystyrene standards; and wherein the molecular weight distribution ($M_w/M_n$) is, for example, from about 1.5 to about 6, optionally and more specifically from about 2 to about 4. The onset glass transition temperature ($T_g$) of the resin as measured by a differential scanning calorimeter (DSC) may be, in embodiments, for example, from about 55° C. to about 70° C., optionally and more specifically from about 55° C. to about 67° C.

In illustrative embodiments, the branched amorphous polyester resins may be generally prepared by the polycondensation of an organic diol, a diacid or diester, a sulfonated difunctional monomer, and a multivalent polyacid or polyol as the branching agent and a polycondensation catalyst.

Examples of diacid or diesters selected for the preparation of amorphous polyesters include but are not limited to dicarboxylic acids or diesters selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin.

Examples of diols that may be utilized in generating the amorphous polyester include but are not limited to 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and mixtures thereof. The amount of organic diol selected can vary, and more specifically, may be for example, from about 45 to about 52 mole percent of the resin.

Alkali sulfonated difunctional monomer examples, wherein the alkali is lithium, sodium, or potassium, include but are not limited to dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.1 to about 2 weight percent of the resin may be selected.

Polycondensation catalyst examples for either the crystalline or amorphous polyesters include but are not limited to tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Branching agents include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. Other branching agents may be suitable. The branching agent amount selected may be, for example, from about 0.1 to about 5 mole percent of the resin.

Various known suitable colorants, such as dyes, pigments, and mixtures thereof may be present in the toner compositions. An effective amount of a colorant, for example, may be from about 1 to about 25 percent by weight of the toner, and optionally it may be found in an amount of from about 2 to about 12 weight percent. The colorant may be carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. Exemplary colored pigments include cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that may be selected are black, cyan, magenta, or yellow, and mixtures thereof. Examples of magentas include 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido)phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants may be incorporated into toners, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Known suitable effective positive or negative charge enhancing additives may also be selected for the toner compositions, for example in an amount of about 0.1 to about 10, and in more specific example about 1 to about 3 percent by weight. Examples of these additives include quaternary ammonium compounds inclusive of alkyl pyridinium halides; alkyl pyridinium compounds, such as those shown U.S. Pat. No. 4,298,672, the disclosure of which is totally incorporated hereby by reference; organic sulfate and sulfonate compositions, such as those shown U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); and the like.

Other toner additives may be blended with the toner compositions, such as external additive particles including flow aid additives, which additives are usually present on the surface thereof. Examples of these additives include metal oxides like titanium oxide, tin oxide, mixtures thereof, and the like; colloidal silicas, such as AEROSIL®, metal salts and metal salts of fatty acids inclusive of zinc stearate, aluminum oxides, cerium oxides, and mixtures thereof, which additives may be present in an amount of from about 0.1 percent by weight to about 5 percent by weight, and more specifically, in an amount of from about 0.1 percent by weight to about 1 percent by weight. Several of the aforementioned additives are illustrated in U.S. Pat. Nos. 3,590,000; 3,800,588, and 6,214,507, the disclosures which are totally incorporated herein by reference.

The crystalline resin may generally be present in the toner in an amount of from about 10 to about 40 percent by weight, and optionally from about 15 to about 25 percent by weight. The branched amorphous resin is generally present in the toner in an amount of from about 60 to about 90 percent by weight, and optionally from about 70 to about 85 percent by weight. The colorant may be present in an amount of from about 2 to about 15 percent by weight, and optionally, a wax can be present in an amount of from about 4 to about 12 percent by weight, and wherein the toner components amount to 100 percent of the toner by weight.

The resulting toner particles can possess an average volume particle diameter of about 2 to about 25, from about 3 to about 15, and/or from about 5 to about 7 microns.

Optionally, the toner compositions may include a wax. Examples of suitable waxes include, but are not limited to, polypropylenes and polyethylenes commercially available from Allied Chemical and Petrolite Corporation, wax emulsions available from Michaelman, Inc. and the Daniels Products Company, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected possess, it is believed, a molecular weight ($M_w$) of from about 1,000 to about 1,500, while the commercially available polypropylenes utilized for the toner compositions are believed to have a molecular weight of from about 4,000 to about 5,000. Examples of functionalized waxes include, such as amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro is Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson wax.

In embodiments, the toners may include a sodio-sulfonated branched amorphous polyester resin, a sodio-sulfonated crystalline polyester resin, a colorant, and optionally a wax. In further embodiments, the toners may include a lithium sulfonated branched amorphous polyester resin, a lithium sulfonated crystalline polyester resin, a colorant, and optionally a wax. In still other embodiments, the toners include a sodio-sulfonated branched amorphous polyester resin, a lithium sulfonated crystalline polyester resin, a colorant, and optionally a wax.

In other embodiments, toners in accordance may be prepared by the process that includes aggregating a mixture of a colorant, optionally a wax, and an emulsion resin comprising a branched amorphous resin and a crystalline resin, and then coalescing the aggregate mixture. An emulsion resin is prepared by combining or mixing a branched amorphous resin and a crystalline resin. A pre-toner mixture is prepared by adding a colorant, and optionally a wax or other materials suitable for use in a toner, to the emulsion resin. In embodiments, the pH of the pre-toner mixture is adjusted to between about 4 to about 5. The pH of the pre-toner mixture may be adjusted by an acid such as, for example, acetic acid, nitric acid or the like. Additionally, in embodiments, the pre-toner mixture optionally may be homogenized. If the pre-toner mixture is homogenized, homogenization may be accomplished by mixing at about 600 to about 4,000 revolutions per minute. Homogenization may be accomplished by any suitable means, including, for example, an IKA Ultra Turrax T50 probe homogenizer.

Another exemplary embodiment relates to a process for producing the present toner compositions. The present toners may be made by a variety of known methods, including a direct coalescence process. Formation of ultra-low melt toners may be by polyester emulsion aggregation. Toner compositions may be prepared by chemical process such as those illustrated in U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, U.S. Pat. No. 5,346,797, and U.S. Pub. No. 20040142266, the disclosures of which are totally incorporated herein by reference. Also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,910,387; 5,919,595; 5,916,725; 5,902,710; 5,863,698, 5,925,488; 5,977,210 and 5,858,601, the disclosures of which are totally incorporated herein by reference.

Toner compositions may be incorporated with a carrier to form developer compositions. Developer compositions may thus be comprised of toner resin particles, optional carrier particles, charge enhancing additives, and as colorants red, blue, green, brown, magenta, black, cyan and/or yellow particles, and mixtures thereof.

For the formulation of developer compositions, there are mixed toner and carrier components, particularly those that are capable of triboelectrically assuming an opposite polarity to that of the toner. Accordingly, the carrier particles can be selected to be of a positive or negative polarity enabling the toner particles, which are negatively charged, to adhere to and surround the carrier particles. Illustrative examples of carrier particles include iron powder, steel, nickel, iron, ferrites, including copper zinc ferrites, strontium ferrite, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of, for example, from about 5 to about 30 percent by weight. Polymer coatings not in close proximity in the triboelectric series can also be selected, reference U.S. Pat. Nos. 4,935,326 and 4,937,166, the disclosures of which are totally incorporated herein by reference, including for example Keener and polymethylmethacrylate mixtures (40/60). Coating weights can vary as indicated herein; generally, however, from about 0.3 to about 2, and more specifically, from about 0.5 to about 1.5 weight percent coating weight is selected.

Electrostatographic imaging processes may use the toners and developers herein described. In imaging methods, an electrostatic latent image bearing member containing a layer of marking material, toner particles, or liquid developer, is selectively charged in an imagewise manner to create a secondary latent image corresponding to the first electrostatic latent image on the imaging member. Imagewise charging can be accomplished by a wide beam charge source which generates free mobile charges or ions in the vicinity of the electrostatic latent image coated with the layer of marking material or toner particles. The latent image causes the free mobile charges or ions to flow in an imagewise ion stream corresponding to the latent image. These charges or ions, in turn, are accepted by the marking material or toner particles, leading to imagewise charging of the marking material or toner particles with the layer of marking material or toner particles itself becoming the latent image carrier. The latent image carrying toner layer is subsequently developed by selectively separating and transferring image areas of the toner layer to substrates like paper thereby enabling an output document. Other suitable imaging processes are described in U.S. Pat. No. 6,218,066, herein incorporated by reference in its entirety.

The diameter of the carrier particles, usually spherical in shape, is generally from about 50 microns to about 1,000 microns, and more specifically, from about 70 to about 300 microns in diameter thereby permitting them to possess sufficient density and inertia to avoid adherence to the electrostatic images during the development process. The carrier component may be mixed with the toner composition in various suitable combinations, such as for example, from about 1 to 5 parts per toner to about 100 parts to about 200 parts by weight of carrier.

The toner and developer compositions may be selected for use in electrostatographic imaging apparatuses containing therein conventional photoreceptors providing that they are capable of, for example, being charged negatively. Thus, the toner and developer compositions can be used with layered photoreceptors that can be charged negatively, such as those illustrated in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the desired features are achievable.

The present toners are sufficient for use in an electrostatographic or xerographic process. The present toners may exhibit a minimum fixing temperature of from about 90 to about 120° C. The toners may exhibit a glass transition temperature of from about 45 to about 75° C. The present toners exhibit satisfactory properties when used in a xerographic or electrostatographic process. Such properties may include one or more of a high gloss, which may be in the range of from about 10 to about 90 gloss units, good C-zone and A-zone charging, a fusing latitude of from about 15 to about 90° C., and substantially no vinyl offset.

Toner compositions preferably exhibit ultra-low melt characteristics in that low minimum fixing temperatures of about less than 125° C. may be achieved. The fusing temperature latitude may be broad, preferably about 10° C. to about 90° C. The gloss latitude is preferably wide as well over a range of fusing temperatures. Specifically, a gloss of about 5 to about 75 (as measured at 75°) may be achievable over a range of about 110° C. to about 210° C. fusing temperatures. Additionally, toner compositions of the illustrative embodiments have rheological properties including viscosity, and appropriate hardness, which properties directly relate to toner stability and useful life. A toner composition may possess a Newtonian loss modulus (G") of about 60,000 to about 120,000 Pascal, optionally and more specifically about 80,000 to about 100,000 Pascal, at a temperature of about 65° C. to about 80° C. at a shear rate of about 0.05 to about 0.5 hertz. The toner composition may also exhibit a G" of about 30 to about 400 Pascal, optionally and more specifically about 50 to about 300 Pascal, at a temperature of about 150° C. to about 165° C. at a shear rate of about 0.05 to about 0.5 hertz. The toner composition may have a storage modulus (G') of about 40,000 to about 90,000 Pascal, optionally and more specifically about 50,000 to about 70,000 Pascal, at a temperature of about 65° C. to about 80° C. at a shear rate of about 0.05 to about 0.5 hertz and a G' of about 10 to about 100 Pascal, optionally and more specifically about 20 to about 35 Pascal, at a temperature of about 150° C. to about 165° C. at a shear rate of about 0.05 to about 0.5 hertz. The toner composition may have a ratio of loss modulus (G") to storage modulus (G') of about 1 to about 3 at a temperature of about 65° C. to about 75° C. and a ratio (G"/G') of about 5 to about 7 at a temperature of about 155° C. to about 165° C.

Storage modulus (G') and loss modulus (G") are critical in maintaining stable charge characteristics. When the storage elastic modulus G' is too low or the loss elastic modulus G" is too low, the toner particles may become deformed by the pressure or shearing force applied by a carrier when mixed with a carrier in a developing machine and thus may not be able to maintain stable charge developing characteristics. The toner may also become deformed by the shearing force applied by a cleaning blade in the process of cleaning the toner on a latent image holding member (photoconductor) and cause poor cleaning.

Rheological properties also are important in preventing excessive penetration of the toner into the transfer material, such as paper and formation of offset. The storage modulus and the loss modulus of the ranges described herein therefore are important in prevention the excessive penetration of the toner compositions into paper upon fusing. Therefore, even when the toner suffers a high temperature upon fixing, the viscosity is not excessively decreased.

Storage modulus and loss modulus values may be obtained from measurement of the dynamic viscoelasticity. To explain briefly, during deformation, G' is the elastic stress component of the modulus of elasticity in the relation between the deformation and the reaction force which is generated in response to the deformation, and the energy for this deformation task is stored. G" is the viscosity stress component of the above-described modulus of elasticity, and the energy required for this deformation task is lost in the form of heat. Tan δ (G"/G') is the ratio thereof and is a measurement of the amounts of energy stored and the energy required for the task of deformation.

One rheometer that may be employed in collecting the rheological data is a Rheometrics, Inc. Stress Rheometer SR5000. In performing dynamic mechanical tests, an oscillatory strain was applied to a toner sample and the resulting stress developed in the sample was measured. The stress generated by a visco-elastic material may be separated into two components: an elastic stress (measure of the degree to which a material behaves as an elastic solid) and a viscous stress (the degree to which a material behaves as an ideal fluid). The elastic and viscous stresses are related to the material properties through the ratio of stresses to strain, the modulus. The ratio of the elastic stress to strain is the storage (or elastic) modulus G' and the ratio of the viscous stress to strain is the loss (viscous) modulus G". The complex modulus, G*, is a measure of a material's overall resistance to deformation:

$G^*=G'+iG''$, wherein i is the imaginary unit.

The dynamic viscosity is a measure of the shear rate dependence of the stress and is calculated by dividing the elastic and viscous stress by the strain rate to give η' and η". The complex viscosity, η*, (η* is the vector sum of the elastic and viscous dynamic viscosities):

$$\eta^*=\eta'+i\eta^*.$$

The value of h* is the measure of the overall resistance to flow as a function of shear rate (ω). $\eta^*=G'/\omega$.

Tan Delta (tan δ) is the measure of the elastic modulus loss or the ratio of G" to G' (G"/G').

Each of the branched polyester resin and the crystalline polyester resin may be an alkali sulfonated polyester resin comprising an alkali metal selected from the group consisting of lithium, sodium, potassium, and combinations thereof.

In addition to specifying the toner rheological properties, preferably the resins in the toner composition exhibit exemplary rheological properties as well. For example, the amorphous resin may have a G" of about $1\times10^7$ to about $3\times10^7$ Pascal at a temperature of about 65° C. to about 75° C. and a G" of about 1,500 to about 3,000 Pascal at a temperature of about 155° C. to about 165° C. at a shear rate of about 0.05 to about 0.5 hertz. The amorphous resin may have a G' of about $7\times10^6$ to about $9\times10^6$ Pascal at a temperature of about 65° C. to about 75° C. and a G' of about 10 to about 50 Pascal at a temperature of about 155° C. to about 165° C. at shear rate about 0.05 to about 0.5 hertz. The amorphous resin has a tan δ of about 1 to about 5 at a temperature of about 65° C. to about 75° C. and a tan δ of about 10 to about 30 at a temperature of about 155° C. to about 165° C.

The crystalline polyester resin may have a G' of about 800 to about 1,200 Pascal at a temperature of about 65° C. to about 75° C. and a G' of about 8 to about 15 Pascal at a temperature of about 155° C. to about 165° C. at a shear rate of about 0.05 to about 0.5 hertz. The crystalline polyester resin may have a G" of about 60 to about 100 Pascal at a temperature of about 65 to about 75° C. and a G" of about 0.01 to about 0.05 Pascal at a temperature of about 155° C. to about 165° C. at a shear rate of about 0.05 to about 0.5 hertz. The crystalline polyester resin may have a tan delta of about 10 to about 30 at a temperature of about 65 to about 75° C. and a tan δ of about 500 to about 700 at a temperature of about 155° C. to about 165° C.

The amorphous resin may have a glass transition temperature of about 55 to about 85° C. and a softening point of about 140° C. to about 185° C. The crystalline resin may have a melting point of about 50° C. to about 80° C. The toner may have a high gloss unit of about 50 to about 80 at a temperature of about 80° C. to 180° C. The toner may have a fusing temperature of about 80° C. to about 120° C. The toner may have a fusing latitude of about 50 to about 100° C.

Toner compositions and process for producing such toners according to the present exemplar embodiment are further illustrated by the following examples. The examples are intended to be merely illustrative of the present exemplary embodiment and are not intended to limit the scope of the present exemplary embodiment.

EXAMPLE I

Preparation of a Branched Amorphous Sodium Sulfonated Polyester Resin

A branched amorphous sulfonated polyester resin comprised of 0.425 mole equivalent of terephthalate, 0.080 mole equivalent of sodime 5-sulfoisophthalic acid, 0.4501 mole equivalent of 1,2-propanediol, and 0.050 mole equivalent of diethylene glycol, was prepared as follows. In a one-liter Parr reactor equipped with a heated bottom drain valve, high viscosity double turbine agitator, and distillation receiver with a cold water condenser was charged 388 grams of dimethylterephthalate, 104.6 grams of sodium 5-sulfoisophthalic acid, 322.6 grams of 1,2-propanediol (1 mole excess of glycols), 48.98 grams of diethylene glycol, (1 mole excess of glycols), trimethylolpropane (5 grams) and 0.8 grams of butyltin hydroxide oxide as the catalyst. The reactor was heated to 165° C. with stirring for 3 hours and then again heated to 190° C. over a one hour period, after which the pressure was slowly reduced from atmospheric pressure to about 260 Torr over a one hour period, and then reduced to 5 Torr over a two hour period. The pressure was then further reduced to about 1 Torr over a 30 minute period and the polymer was discharged through the bottom drain onto a container cooled with dry ice to yield 460 grams of sulfonated-polyester resin. The branched sulfonated-polyester resin had a glass transition temperature measured to be 54.5° C. (onset) and a softening point of 154° C.

An aqueous emulsion of the resin was then prepared by dissolving the said resin (200 grams) in 2 Liters of acetone, and adding the dissolved solution drop wise (over a 2 hour period) into a 4 liter kettle, equipped with a heating mantle, a mechanical stirrer and distillation apparatus, and comprised of 2.25 liters of water heated to 80° C. The acetone was collected in the distillation receiver. The aqueous resin emulsion displayed a particle size of 225 nanometers.

EXAMPLE II

Preparation of Crystalline Sodium Sulfonated Polyester Resin (CSPE)

A crystalline linear sulfonated polyester resin comprised of 0.35 mole equivalent of succinic acid, 0.15 mole equivalent of sodium 5-sulfoisophthalic acid and 0.05 mole equivalent of ethylene glycol was prepared as follows. In a two-liter Parr reactor equipped with a heated bottom drain valve, high viscosity double turbine agitator, and distillation receiver with a cold water condenser were charged 285 grams of succinic acid, 30.6 grams of sodium 5-dimethylsulphoisophthalic acid, 208 grams of ethylene glycol, and 0.8 grams of butyltin hydroxide oxide as the catalyst. The reactor was heated to 165° C. with stirring for 3 hours and then heated to 190° C. over a one hour period, after which the pressure was slowly reduced from atmospheric pressure to about 260 Torr over a one hour period, and then reduced to 5 Torr over a two hour period, and then further reduced to about 1 Torr over a 30 minute period. The polymer was discharged through the bottom drain onto a container full of ice water to yield 460 grams of 7.5 mole percent sulfonated-polyester resin. The sulfonated-polyester resin had a softening point of 93° C. (29 Poise viscosity measured by Cone & Plate Viscometer at 199° C.) and a melting point range of 60 to 80° C. as measured by DSC.

An aqueous emulsion of the resin was then prepared by adding the above resin to a 4 Liter kettle. Equipped with a mechanical stirrer and heating mantle, and comprised of 2.25 liters of water heated to 95° C. The heating (95° C.) was maintained for about 1.5 hours, and then allowed to cool to room temperature to result in an aqueous polyester emulsion with a particle size of 155 nanometers.

EXAMPLE III

Toner Preparation by Mixing of Separate Emulsions

A mixture of the branched sulfonated amorphous polyester resin (BSPPE-1) emulsion, as prepared in Example I and the crystalline polyester (CSPE) emulsion as prepared in Example II was added to a 2 liter Bucchi reactor, with 4% by weight of Cyan 15:3 (Flexiverse) and 9% by weight of Carnauba wax, and the mixture heated to 80° C., with the addition of zinc actetate (3% solution) over a 3 hour period to result in toner particles. The toners are displayed in Table 1, entries A-C. GSD represents the geometric size distribution. It is the square root of $D_{84}/D_{16}$, wherein D stands for average volume particle size taken at the 84 and 16 of the Gaussian distribution.

TABLE 1

| Entry | Resin Composition | Particle Size | GSD |
|---|---|---|---|
| A | 10% CSPE, 90% BSPE-1 | 6.0 | 1.18 |
| B | 15% CSPE, 85% BSPE-1 | 5.5 | 1.18 |
| C | 20% CSPE, 80% BSPE-1 | 5.6 | 1.19 |
| D | 20% CSPE, 80% BSPE-1 | 6.2 | 1.22 |

EXAMPLE III

Toner Preparation by Melt Mixing of Resins

A mixture of 80% branched sulfonated amorphous polyester resin (BSPPE-1), as prepared in Example I and the crystalline polyester (CSPE) as prepared in Example II was melt mixed in a 1 liter Parr reactor to a temperature of 150 to 160 C for 10 minutes, discharged and cooled to room temperature. The mixed resin was then emulsified in water (10% solids) by heating to 90 C with stirring for 1 hour. To the emulsion mixture, was then added 4% by wight of Cyan 15:3 (Flexiverse) and 9% by weight of Carnauba wax, and the mixture heated to 80° C., with the addition of zinc actetate (3% solution) over a 3 hour period to result in toner particles. The toners are displayed in Table 1, entries D.

EXAMPLE IV

Toner Fusing Testing

The toners A-D of Table 1 were evaluated using a Xerox Docucolor DC2240 production fuser. Samples were fused at 194 mm/s onto Color Expressions (90 gsm) paper for gloss and crease measurements while hot offset performance was examined with the samples printed on S paper (60 gsm) and the fuser running at 104 mm/s, wherein gsm equals grams per square meter.

Toners A-D exhibited a wide range of gloss values over the fusing temperatures. Specifically, over a range of 110° C. to 210° C., a gloss value of 15 to 75 is obtainable, wherein the gloss measurement is at 75°. At 175° C., all toners A-D exhibit a gloss value of greater than 60.

EXAMPLE V

Fusing

The toners A-D, were evaluated using the Xerox Docucolor DC2240 printer. The toners were fused at 194 mm/s onto Color Xpressions (90 gsm) paper for gloss and minimum fixing temperature (MFT) while hot offset performance was examined with the samples printed on S paper (60 gsm) and the fuser running at 104 mm/s. The fusing performance of the Toners are listed in Table 2.

TABLE 2

| Toner | MFT | Hot-Offset |
|---|---|---|
| A | 125 | 165 |
| B | 119 | 170 |
| C | 125 | 130 |
| D | 119 | 155 |

The toners exhibit a low MFT and a broad latitude in temperature fusing, which will result in reduced power consumption and improved life and reliability in the fuser.

The toner compositions according to the present exemplary embodiment also exhibit satisfactory charging performance. Specifically, the toners exhibit both satisfactory C-zone and A-zone charging.

EXAMPLE VI

Preparation of a Toner Comprised of Amorphous Polyester and Crystalline Polyester A 5.9 micron cyan toner comprised of a blend of 80% branched sodio-sulfonated polyester core resin and 20% crystalline sodio-sulfonated polyester core resin, carnauba wax and pigment blue 15:3 colorant was prepared as follows. A 1.19 liter colloidal solution containing 891 grams of 10.8 percent by weight of the branched 1.5% sodio-sulfonated polyester resin and 297 grams of 8.1 percent by weight of the crystalline 3.5% sodio-sulfonated polyester resin was charged into a 2 liter Buchi equipped with a mechanical stirrer containing two P4 45° angle blades. To this Buchi mixture was added 64 grams of 19.7 weight of a carnauba wax dispersion, as well 29.5 grams of a cyan pigment dispersion containing 28.6 percent by weight of Pigment Blue 15:3 (made with Neogen RK surfactant). The pre-toner mixture was then pH adjusted to 3.96 (from 4.98) with 0.13 grams of acetic acid. The resulting mixture was heated to 70° C. over 45 minutes with stirring at 600 revolutions per minute. To this heated mixture was then added drop wise 184.5 grams of an aqueous solution containing 4.6 percent by weight of zinc acetate dehydrate; this solution was also pH adjusted from 5.89 to 4.06 with 4.07 grams of acetic acid. The dropwise addition of the zinc acetate dihydrate solution was accomplished utilizing a peristaltic pump, at a rate of addition of approximately 0.6 to 0.8 mL per minute. The first batch of zinc solution (6.5 grams zinc acetate dihydrate in 41 grams deionized water) was added over at 295 minutes until 366 minutes into the reaction.

The reaction was turned off or heating was stopped overnight at 575 minutes and reheated the next day to 71° C. for 191 minutes. At 766 minutes, the temperature was increased to 73° C. until the reaction reached 875 minutes. The mixture was then allowed to cool to room temperature, retrieved from the Buchi. A particle size of 5.90 microns with a GSD of 1.28 was measured by the Coulter Counter. The product was filtered through a 25 micron stainless steel screen (#500 mesh), left in its mother liquor and settled overnight. The next day the mother liquor, which contained fines, was decated from the toner cake which settled to the bottom of the beaker. The settled toner was re-slurried in 1.5 liter of deionized water, stirred for 30 minutes, and then settled again overnight. This procedure was repeated once more until the solution conductively of the filtrate was measured to be about 25 microseimens per centimeter which indicated that the washing procedure was sufficient. The toner cake was redispersed into 200 mL of deionized water, and freeze-dried over 72 hours. The final dry yield of toner was measured to be 101.7 grams.

EXAMPLE VII

Rheological Data

A rheometer employed in collecting the rheological data was a Rheometrics, Inc. Stress Rheometer SR5000. In performing dynamic mechanical tests, an oscillatory strain was applied to a toner sample and the resulting stress developed in the sample was measured.

The viscoelasticity was measured by using a rotational plate type rheometer. The measurement is carried out in the following manner. A sample is set in a sample holder, and measurement is carried out at a temperature increasing rate 1° C./min, a frequency of 0.1 rad/s (or 0.1 hertz), a distortion of 20% or less and a detection torque within the measurement certified range. The sample holders of 8 mm and 20 mm are selected depending on necessity.

Changes of the storage modulus G' (Pa) and the loss modulus G" (Pa) are obtained with respect to the temperature change.

The oscillatory strain applied to the sample was about 0.1 hertz. The following Table 3 is a summary of the rheological properties of the toner of Example VI, the branched resin of Example I and the crystalline resin of Example II.

TABLE 3

| | Rheological Data | | | | | |
|---|---|---|---|---|---|---|
| | G" at 0.1 Hz (Pa) | | G' at 0.1 Hz (Pa) | | Tan delta | |
| | Temperature | | | | | |
| | 70 (° C.) | 160 (° C.) | 70 (° C.) | 160 (° C.) | 70 (° C.) | 160 (° C.) |
| Toner - Example VI | 97,000 | 164 | 64,000 | 28 | 1.52 | 5.88 |
| Branched resin - Example I | 16,200,000 | 2291 | 8,000,000 | 80 | 1.98 | 28.5 |
| Crystalline Resin - Example II | 94 | 9.7 | 81 | 0.015 | 12.26 | 629 |

EXAMPLE VIII

Fusing Performance of the Toner Composition of Example VI

The fusing performance was measured with a Xerox Docucolor DC2240 production fuser and was fused at 194 mm/s onto Color Expression (90 gsm) paper for gloss and crease while hot offset performance was examined with the samples printed on S paper (60 gsm) and the fuser running at 104 mm/s. The toner of Example VI was glossier than a control sample ("Control"), which is comprised of the Xerox DocuColor DC2240 Cyan Toner. A wide spectrum of gloss may be obtained across fusing temperatures. The gloss of the toner of Example VI ranges from 15 to 65, while the fusing temperature ranges from 110 to 210° C. Specifically, at about 160° C. to about 195° C., gloss values of greater than about 60 are achieved.

The toner of Example VI displayed an ultra-low crease minimum fixing temperature (−33° C.). The crease area ranges from about 2 to about 300 over a temperature of about 147° C. to about 114° C., respectively.

The fusing latitude of the toner of Example VI was about 60° C. The minimum fixing temperature of the toner of Example VI is about 125° C. and the hot offset of the toner of Example VI is about 185° C.

The Fusing Data of the toner of Example VI is summarized in Table 4, which compares the toner of Example VI to the Control toner.

TABLE 4

| Toner | Gloss at MFT (ggu) | Gloss at 180° C. | Gloss Range | Peak Gloss (ggu) | Crease fix MFT | Fusing Latitude |
|---|---|---|---|---|---|---|
| Toner - Example VI | 22 | 66 | 44 | 66 | 124 | 61 |
| Control Toner | 17 | 40 | 23 | 58 | 154 | 51 |

Thus, toner compositions and a process for preparing such compositions have been provided. The toners comprising a combination of an alkali sulfonated branched amorphous polyester and an alkali sulfonated crystalline polyester resin exhibit properties making them suitable for use as ultra-low melt toners in electrostatographic or xerographic processes or devices, such as a xerographic apparatus comprising a charging component, a photoreceptor component, a development component, and a transfer component. The toners exhibit good viscosity properties, charging properties, and a satisfactory fusing and gloss latitude. In particular, toners wherein the alkali metal in the polyester resins is sodium provide a useful toner.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A toner composition comprising:

a branched amorphous sulfonated polyester resin; and a crystalline sulfonated polyester resin;

wherein the toner composition possesses a Newtonian loss modulus (G") of about 60,000 to about 120,000

Pascal at a temperature of about 65° C. to about 80° C. at a shear rate of about 0.05 to about 0.5 hertz and a G" of about 30 to about 400 Pascal at a temperature of about 150° C. to about 165° C. at a shear rate of about 0.05 to about 0.5 hertz; and wherein the toner composition possesses a storage modulus (G') of about 40,000 to about 90,000 Pascal at a temperature of about 65° C. to about 80° C. at a shear rate of about 0.05 to about 0.5 hertz and a G' of about 10 to about 130 Pascal at a temperature of about 150° C. to about 165° C. at a shear rate of about 0.05 to about 0.5 hertz.

2. The toner composition of claim 1, wherein the toner composition possesses a Newtonian loss modulus (G") of about 80,000 to about 100,000 Pascal at a temperature of about 65° C. to about 75° C. at a shear rate of about 0.05 to about 0.5 hertz and a G" of about 50 to about 300 Pascal at a temperature of about 155° C. to about 165° C. at a shear rate of about 0.05 to about 0.5 hertz; and wherein the toner composition possesses a storage modulus (G') of about 50,000 to about 70,000 Pascal at a temperature of about 65° C. to about 75° C. at a shear rate of about 0.05 to about 0.5 hertz and a G' of about 10 to about 100 Pascal at a temperature of about 155° C. to about 165° C. at a shear rate of about 0.05 to about 0.5 hertz.

3. The toner composition of claim 1, wherein a ratio of loss modulus (G") to storage modulus (G') is about 1 to about 3 at a temperature of about 65° C. to about 75° C. wherein the ratio (G"/G') is about 5 to about 7 at a temperature of about 155° C. to about 165° C.

4. The toner composition of claim 1, wherein each of the branched polyester resin and the crystalline polyester resin comprise an alkali sulfonated polyester resin comprising an alkali metal selected from the group consisting of lithium, sodium, potassium, and combinations thereof.

5. The toner composition of claim 1, wherein the branched amorphous polyester resin is selected from the group consisting of metal and alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly (diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate).

6. The toner composition of claim 1, wherein the crystalline polyester resin is selected from the group consisting of alkali copoly(5-sulfoisophthaloyl)-co-poly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly (pentylene-adipate), and alkali copoly(5-sulfo-iosphthaloyl)-copoly(octylene-adipate), alkali copoly(5-sulfo-isophthaloyl)-copoly(ethylene-adipate), alkali copoly (5-sulfo-isophthaloyl)-copoly (propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isopthaloyl)-copoly(hexylene-adipate), alkali copoly(5-sulfo-isophthaloyl)-copoly(octylene-adipate), alkali copoly(5-sulfoisophthaloyl)-copoly (ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly (butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly(pentylene-adipate), and alkali copoly(5-sulfo-isophthaloyl)copoly (hexylene-adipate).

7. The toner composition of claim 1, further comprising a colorant.

8. The toner composition of claim 7, wherein the amorphous branched resin is present in an amount of from about 40 to about 90 percent of the toner; wherein the crystalline resin is present in an amount of from about 5 to about 40 percent of the toner; and wherein the colorant is present in an amount of from about 3 to about 15 percent of the toner.

9. The toner composition of claim 7, wherein the colorant is selected from a pigment or a die and comprises carbon black, cyan, magenta, yellow, red, blue, green, brown, or mixtures thereof.

10. The toner composition of claim 1, further comprising a wax.

11. The toner composition of claim 1, further comprising an additive selected from the group consisting of quaternary ammonium compounds, organic sulfate and sulfonate compositions, cetyl pyridinium tetrafluoroborates, distearyl dimethyl ammonium methyl sulfate, aluminum salts, metal oxides, colloidal silicas, metal salts and metal salts of fatty acids, and mixtures thereof.

12. The toner composition of claim 1, wherein the amorphous resin possesses a G" of about $1\times10^7$ to about $3\times10^7$ Pascal at a temperature of about 65° C. to about 75° C. and a G" of about 1,500 to about 3,000 Pascal at a temperature of about 155° C. to about 165° C. at a shear rate of about 0.05 to about 0.5 hertz, wherein the amorphous resin possesses a G' of about $7\times10^6$ to about $9\times10^6$ Pascal at a temperature of about 65° C. to about 75° C. and a G' of about 10 to about 50 Pascal at a temperature of about 155° C. to about 165° C. at a shear rate of about 0.05 to about 0.5 hertz, and wherein the amorphous resin possesses a ratio of G"/G' of about 1 to about 5 at a temperature of about 65° C. to about 75° C. and a ratio of G"/G of about 10 to about 30 at a temperature of about 155° C. to about 165° C.

13. The toner composition of claim 1, wherein the crystalline resin possesses a G" of about 800 to about 1200 Pascal at a temperature of about 65° C. to about 75° C. and a G" of about 8 to about 15 Pascal at a temperature of about 155° C. to about 165° C. at a shear rate of about 0.05 to about 0.5 hertz, wherein the crystalline resin possesses a G' of about 60 to about 100 Pascal at a temperature of about 65° C. to about 75° C. and a G' of about 0.1 to about 0.5 Pascal at a temperature of about 155° C. to about 165° C. at a shear rate of about 0.05 to about 0.5 hertz, and wherein the crystalline resin possesses a ratio of G"/G' of about 10 to about 30 at a temperature of about 65° C. to about 75° C. and a ratio of G"/G of about 500 to about 700 at a temperature of about 155° C. to about 165° C.

14. The toner composition of claim 1, wherein the toner exhibits a high gloss unit of about 50 to 80 at a temperature of about 80° C. to about 180° C.

15. The toner composition of claim 1, wherein the toner exhibits a fusing temperature of about 90° C. to about 135° C.

16. The toner composition of claim 15, wherein the toner exhibits a fusing temperature of about 100° C. to about 125° C.

17. The toner composition of claim 1, wherein the toner exhibits a fusing latitude of about 50° C. to about 100° C.

18. A toner composition comprising:

a branched amorphous sulfonated polyester resin; and a crystalline sulfonated polyester resin;

wherein the toner composition has a Newtonian loss modulus (G") of about 60,000 to about 120,000 Pascal at a temperature of about 65° C. to about 80° C. at a shear rate of about 0.05 to about 0.5 hertz; and wherein the toner composition has a storage modulus (G') of about 40,000 to about 90,000 Pascal at a temperature of about 65° C. to about 80° C. at a shear rate of about 0.05 to about 0.5 hertz.

19. The toner composition of claim 18, further comprising a colorant.

20. The toner composition of claim 18, wherein the amorphous branched resin is present in an amount of from about 40 to about 90 percent of the toner; wherein the crystalline resin is present in an amount of from about 5 to about 40 percent of the toner; and wherein the colorant is present in an amount of from about 3 to about 15 percent of the toner.

21. The toner composition of claim 18, further comprising a wax.

22. The toner composition of claim 18, further comprising an additive selected from the group consisting of quaternary ammonium compounds, organic sulfate and sulfonate compositions, cetyl pyridinium tetrafluoroborates, distearyl dimethyl ammonium methyl sulfate, aluminum salts, metal oxides, colloidal silicas, metal salts and metal salts of fatty acids, and mixtures thereof.

23. A toner composition comprising:

a branched amorphous sulfonated polyester resin; and a crystalline sulfonated polyester resin;

wherein the toner composition has a Newtonian loss modulus (G") of about 30 to about 400 Pascal at a temperature of about 150° C. to about 165° C. at a shear rate of about 0.05 to about 0.5 hertz; and wherein the toner composition has a storage modulus (G') of about 10 to about 130 Pascal at a temperature of about 150° C. to about 165° C. at a shear rate of about 0.05 to about 0.5 hertz.

24. The toner composition of claim 23, further comprising a colorant.

25. The toner composition of claim 23, wherein the amorphous branched resin is present in an amount of from about 40 to about 90 percent of the toner; wherein the crystalline resin is present in an amount of from about 5 to about 40 percent of the toner; and wherein the colorant is present in an amount of from about 3 to about 15 percent of the toner.

26. The toner composition of claim 23, further comprising a wax.

27. The toner composition of claim 23, further comprising an additive selected from the group consisting of quaternary ammonium compounds, organic sulfate and sulfonate compositions, cetyl pyridinium tetrafluoroborates, distearyl dimethyl ammonium methyl sulfate, aluminum salts, metal oxides, colloidal silicas, metal salts and metal salts of fatty acids, and mixtures thereof.

* * * * *